United States Patent [19]

Grehl

[11] 4,270,295

[45] Jun. 2, 1981

[54] FIRING-PIN BLOCKING DEVICE FOR FIREARMS

[75] Inventor: William H. Grehl, Wallingford, Conn.

[73] Assignee: O. F. Mossberg & Sons, Inc., North Haven, Conn.

[21] Appl. No.: 67,951

[22] Filed: Aug. 20, 1979

[51] Int. Cl.[3] ..... F41C 17/04

[52] U.S. Cl. ..... 42/70 F

[58] Field of Search ..... 42/70 F; 89/142, 148, 89/154

[56] References Cited

U.S. PATENT DOCUMENTS

| | | | |
|---|---|---|---|
| 2,626,474 | 1/1953 | Lochhead | 42/70 F |
| 2,848,832 | 8/1958 | Lee | 42/70 F |
| 3,601,918 | 8/1971 | Keppeler | 42/70 F |

*Primary Examiner*—Charles T. Jordan

*Attorney, Agent, or Firm*—St. Onge, Steward, Johnston, Reens & Noë

[57] ABSTRACT

A device for positively blocking the firing pin in a firearm having a reciprocating breech-bolt that is substantially enclosed within the receiver, in which a fingerpiece is provided on the outside of the receiver for shifting a safety bar into and out of a position to move a member on the breech-bolt into or out of a blocking position with respect to the firing pin such that the firing pin can not be driven home to discharge a cartridge.

6 Claims, 4 Drawing Figures

FIRING-PIN BLOCKING DEVICE FOR FIREARMS

BACKGROUND OF THE INVENTION

The invention relates to devices for preventing accidental firing of firearms, commonly referred to in the patents as safety devices, and it relates more particularly to devices for positively blocking the firing pin in firearms of the type which have a reciprocating breech-bolt that is enclosed within the receiver or housing. Such firearms include, for example, automatic shotguns and rifles as well as manually operating repeating firearms, such as slide-actions which are frequently referred to as pump-actions.

Most, if not all, firearms manufactured today are provided with means for locking the firing mechanism in order to reduce the chances of the firearm being accidentally discharged. In some cases the trigger is blocked so that it can not be retracted far enough to release the firing member. Where the firing mechanism includes a separate sear member, some means may be provided for locking the sear in engagement with the cocked hammer or striker, in order to prevent its release until the sear is unlocked. A more positive way of preventing accidental discharge of a firearm is to provide means for blocking the firing member itself, so that it can not engage the primer in the cartridge. However, in the type of gun which has a reciprocating breech-bolt that is enclosed within the receiver, as for example in the autoloading shotgun shown in the U.S. patent to Liedke U.S. Pat. No. 4,017,996, there is little or no access to the bolt for manually blocking the firing pin due to the fact that it is carried on, and reciprocates with the bolt. In fact to my knowledge, no means have ever been devised for locking and unlocking the firing pin by hand in this type of firearm.

It is an object of the present invention to provide a firing-pin safety device for such firearms in which a finger piece is provided on the outside of the receiver and is so arranged that when the action is closed, the firing pin can be locked or unlocked, respectively, by manually moving the finger piece on its "on" or "off" positions.

SUMMARY OF THE INVENTION

The invention resides in providing a member, hereinafter referred to as the firing-pin "blocking member", which is carried by the breech-bolt for movement into and out of blocking relationship with the firing pin. In addition, a safety bar is provided on the receiver for moving the blocking member into or out of its blocking position, and is mounted independently of the blocking member so that is does not interfere with the movement of the breech-bolt between its closed and retracted position. To this end, an actuator on the safety bar is positioned with respect to the breech-bolt for operative engagement with the blocking member whenever the breech-bolt is closed. Thus, with the breech-bolt in battery and with the safety bar in its "on" position, the blocking member is held by the actuator in blocking relation with the firing pin. By moving the safety bar to its "off" position the blocking member releases the firing pin. The safety bar also has a finger-piece which is accessible externally of the receiver for manually moving the safety bar to and from its "on" position. The same safety arrangement is applicable for firing mechanisms which employ a spring-loaded striker, instead of a hammer and firing pin.

When the safety is on, the actuator holds the blocking member in a position in which it positively blocks the firing member so that it can not fire a cartridge in the chamber of the barrel. By manually moving the finger-piece to its "off" or firing position, the blocking member is moved out of its blocking position, in order to allow the firing member to strike the chambered cartridge when the trigger is pulled. However, as will become more apparent hereinafter, the interaction of the receiver-mounted safety bar and the bolt-mounted blocking member in no way interferes with reciprocation of the breech-bolt regardless of the position of the safety bar.

The firing-pin blocking device of the present invention is especially advantageous when used in combination with the conventional trigger-blocking safety, thereby virtually eliminating the chances of the firearm being discharged accidentally as long as the safety is "on". Thus, when the firing-pin blocking safety system of the present invention is provided, the firing pin is positively blocked thereby preventing accidental discharge of the cartridge even if the hammer accidentally releases. A particularly desirable aspect of the invention therefore resides in its capability for use in conjunction with, or as a part of, conventional trigger-blocking safety mechanisms.

DETAILED DESCRIPTION OF PREFERRED EMBODIMENT

The invention will be more clearly understood by reference to the accompanying drawing in which FIG. 1 is a fragmentary longitudinal, vertical sectional view through the center of the receiver of an automatic shotgun in which the safety mechanism of the present invention is employed;

Figure 1:
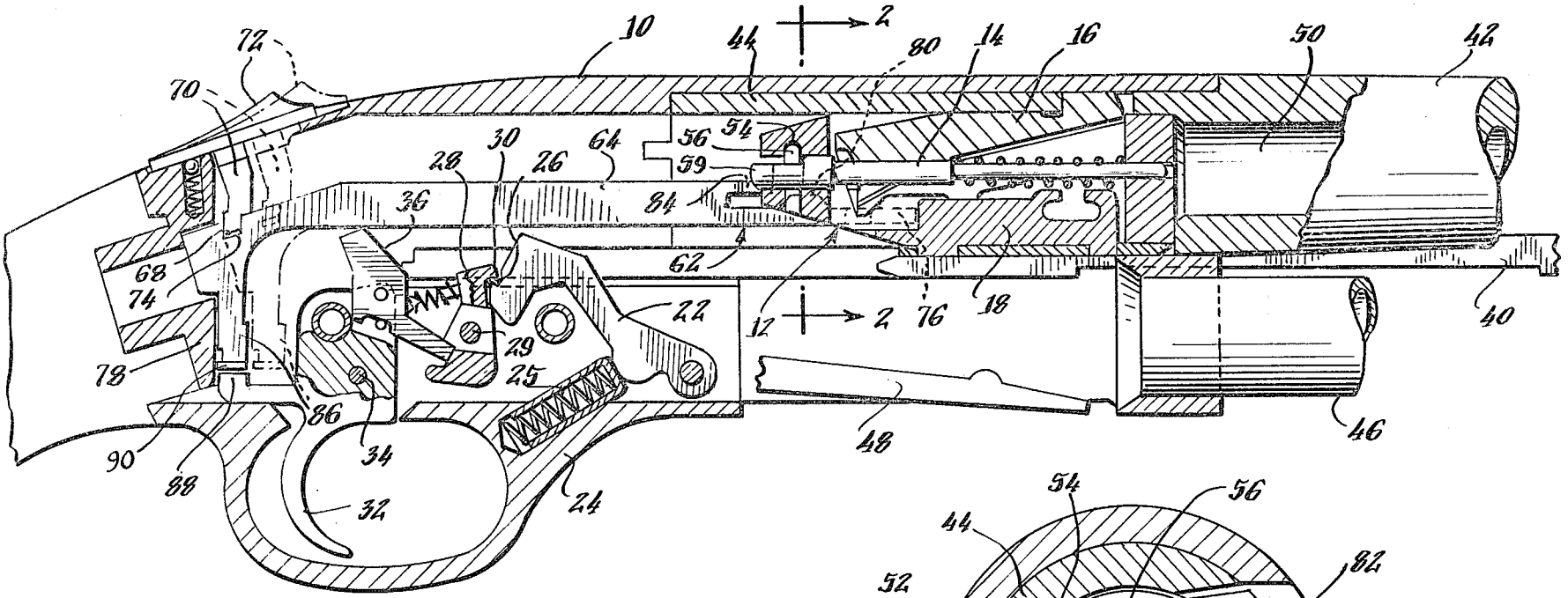

The embodiment of the invention shown in the drawings is described in connection with an automatic shotgun having a cartridge loading and firing mechanism similar to that disclosed in the aforementioned U.S. Pat. No. 4,017,996 to Carl F. Liedke. A receiver 10 houses the breech-bolt mechanism which reciprocates during each reloading cycle between a breech-closing position and a retracted position. The breech-bolt mechanism consists of a bolt 12, which has a firing pin 14, as well as bolt-locking member 16 for positively locking the breech-bolt mechanism in battery. In this instance the breech-bolt mechanism also includes a slide-member 18, on which the bolt 12 is carried into and out of breech-closing or battery position.

A hammer 22 is pivotally mounted on the trigger plate 24 for pivotal movement between its fired position and a cocked position, and is driven to its fired position by a hammer spring 25. Hammer 22 is provided with a cocking notch 26, by which it is held cocked by a sear 28 pivotally mounted at 29 on trigger plate 24 rearward of hammer 22. A hooked nose 30 on sear 28 engages the cocking notch 26 to cock hammer 22 against the pressure of spring 25. A trigger 32 is pivoted in the usual manner on a trigger pin 34 fixed in trigger plate 24. A disconnector 36 is pivotally mounted on trigger 32 for disengaging sear 28 from the cocking notch 26 of the hammer on retraction of trigger 32, thereby releasing hammer 22 to fire a cartridge, in the manner disclosed in the aforementioned Liedke patent.

Actuation of the bolt is accomplished either manually by means of a finger piece (not shown) projecting laterally from the slide 18, or automatically by a gas-cylinder (likewise not shown) forward of the receiver 10 through a pair of action-bars 40, one of which is shown in FIG. 1. Action-bars 40 are rigidly connected to, and form part of, the slide 18 for reciprocating bolt 12. In so-called pump-action firarms, in which the present invention may be employed, actuation of the bolt is of course accomplished manually by means of a conventional fore-end grip, to which the action-bars 40 may be connected.

A gun barrel 42 is removably fixed to the receiver 10 by suitable means, including an extension 44 thereof which fits inside receiver 10 through an opening in its front end. A tubular magazine 46 is mounted below barrel 42 with its open end rigidly held in a second opening in the front of receiver 10, through which cartridges are fed in the usual manner onto a cartridge-carrier, a portion of which is shown diagrammatically at 48. Bolt-locking member 16 locks into the barrel extension 44 as illustrated in FIG. 1. When the breech-bolt 12 is unlocked and then retracted rearwardly in the receiver from its battery position, a cartridge is released from magazine 46 onto cartridge-carrier 48, and on the return stroke of the breech-bolt, the cartridge is lifted upward by carrier 48 in front of bolt 12, so that it is driven by the bolt into the firing chamber 50 in barrel 42. When the breech-bolt is home, bolt-locking member 16 is pivoted upward into a locking notch in the barrel extension 44 to lock the breech-bolt 12 in the chamber-closing position. During the reloading cycle, hammer 22 is cocked by the breech-bolt so that it is ready to fire the cartridge.

Figure 2:
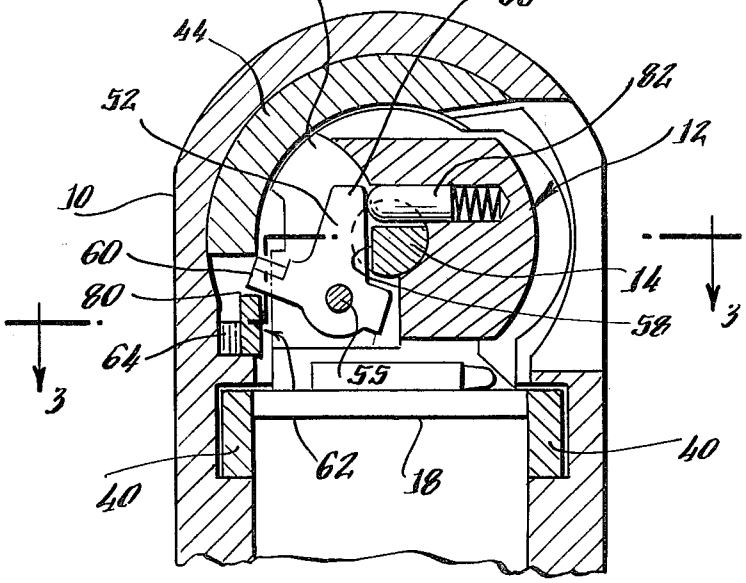
FIG. 2 is an enlarged vertical cross-sectional view taken on the line 2—2 of FIG. 1.
Figure 3:
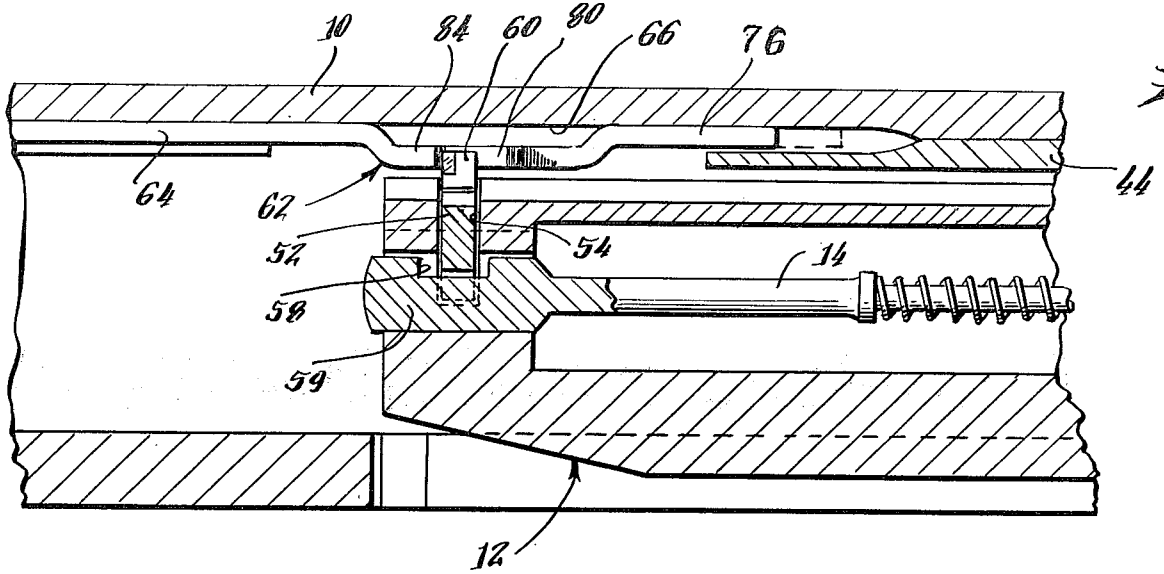
FIG. 3 is a fragmentary horizontal sectional view taken on the line 3—3 of FIG. 2.

In accordance with the present invention, the firing pin 14 can be positively prevented from striking the primer on the loaded cartridge in chamber 50 by means of a firing-pin blocking member 52, which is pivotally mounted on breech-bolt 12 near the rear end thereof. As best illustrated in FIGS. 2 and 3, blocking member 52 is disposed in a transverse slot 54 in the side of bolt 12 for pivotal movement about a pivot pin 55 located on a level somewhat below firing pin 14. Blocking member 52 has an upwardly projecting finger 56 which moves into and out of an enlongated notch 58 (FIG. 3) in the adjacent side of an enlarged head-portion 59 at the rear end of firing pin 14. When blocking member 52 is pivoted clockwise (as viewed in FIG. 2) into the notch 58 in the firing pin, the firing pin is positively blocked against movement into contact with the cartridge.

A projection 60 extends generally laterally from blocking member 52 and outward of bolt 12 into the path of an actuator 62 on a safety bar 64 in the side wall of receiver 10. Safety bar 64, which is an elongated member disposed within a groove 66 (FIG. 3) in the inner surface of the receiver and running longitudinally thereof, extends to the rear of the receiver where it is engaged by a foot 68 at the lower end of a link 70 depending from a finger-piece 72 slidably supported on the outer surface of the tang portion of receiver 10. Finger-piece 72 is desirably located on top of the receiver for ready manipulation by the thumb of the person firing the gun. Foot 68 is received in a vertical slot 74 in the upper edge of safety bar 64, so that it is free to move upward slightly with respect thereto when the finger-piece 72 is moved forward to the position shown in FIG. 1.

Figure 4:
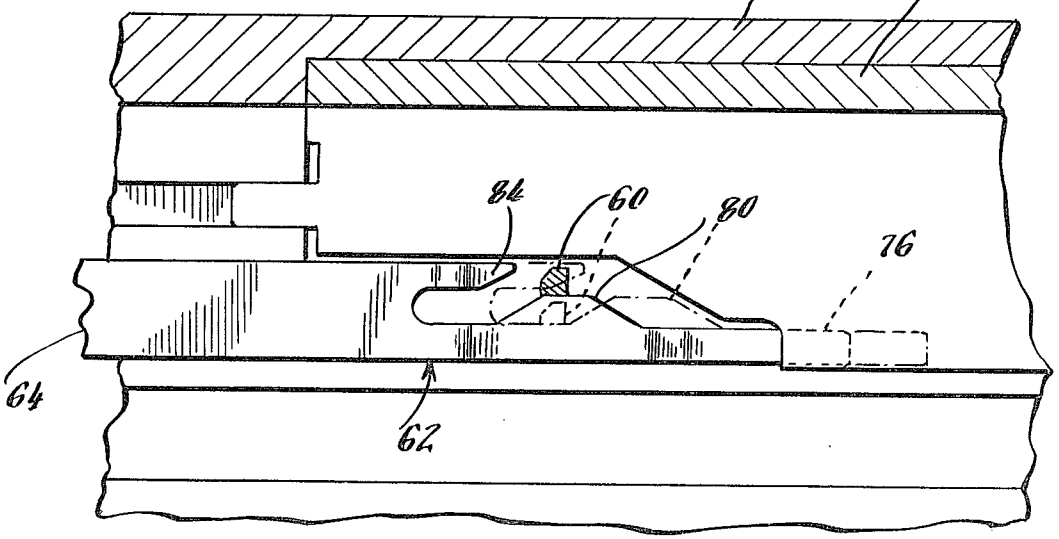
FIG. 4 is a fragmentary longitudinal sectional view of the mid-portion of the receiver and rear-portion of the barrel extension with the breech-bolt removed in order to show the actuator on the safety bar.

As clearly illustrated in FIGS. 3 and 4, the forward tip 76 of safety bar 64 is retained in groove 66 by a portion of the barrel extension 44. The rear portion of safety bar 64 is retained in groove 66 by a bumper block (not shown) which fits inside the receiver against the rear wall 78 thereof, the primary purpose of the bumper block being to absorb the impact of the breech-bolt 12 as it reaches its limit of travel.

The actuator portion 62 of safety bar 64 consists of a cam 80 located on the upper edge of a long, forwardly extending finger of reduced vertical dimension, which terminates in the tip 76 of bar 64, the lower edge of which is co-extensive with the lower edge of the main portion of the safety bar. As illustrated in FIG. 3 the actuator portion 62 is formed in this instance by bending a short section of bar 64 inward toward the breech-bolt 12, so that it is off-set inwardly of the main portion of the bar by approximately the thickness thereof. Cam 80 is thus disposed in vertical alignment with the outer end of the projection 60 on blocking member 52 for engagement therewith.

As will be noted in FIG. 1, actuating cam 80 is disposed longitudinally of safety bar 64 such that when the safety bar is in its rear position, as illustrated in full lines in the drawings, and the breech-bolt 12 is forward, the projection 60 on blocking member 52 is exactly opposite the high point of cam 80 (FIG. 4). Blocking member 52 is thus pivoted to its blocking position by cam 80 against a spring-plunger 82 located in a recess in breech-bolt 12 (FIG. 2). Actuator 62 is also desirably provided with a short cam finger 84 extending forward from the upper edge of safety bar 64 to a point immediately to the rear of cam 80. The under edge of cam finger 84 is inclined at the same angle as the back side of cam 80 and is spaced therefrom to permit disposition of projection 60 between them. Cam finger 84 is also bent so that it is off-set inwardly into alignment with projection 60, such that when safety bar 64 is shifted forward to the broken-line position shown in FIG. 4, cam finger 84 can engage projection 60 and positively cam it downward.

It is apparent, therefore, that when the breech-bolt is in battery, the firing pin 14 is blocked when the finger-piece 72 of the safety is located in, or is moved to, its rear or "on" position, so that cam 80 pivots blocking member 52 upward into blocking relation with firing pin 14. Thus, if hammer 22 accidentally falls striking the firing pin, a loaded cartridge in the chamber 50 will not be discharged. On moving finger-piece 72 forward to its "off" position, shown in the drawings in broken lines, safety bar 64 is moved forward, shifting cam 80 forward of projection 60 so that blocking member 52 is pivoted by spring plunger 82 to its retracted position. The firing pin is then free to strike the primer of a loaded cartridge when the hammer falls. If for any reason the spring plunger 82 can not move the blocking member 52 out of its blocking position, the finger cam 84 will come into engagement with projection 60 and positively cam it down.

In some circumstances where, as here, two cams are provided for positively moving the blocking member both into, and out of, blocking position, the spring plunger 82 for the blocking member can be eliminated. On the other hand, if the spring plunger 82 is provided, the cam finger 84 could be eliminated. Alternatively, the blocking member 52 can be spring-loader either into, or out of blocking position, in which case it must be positively cammed at least into its blocking position, in order to ensure that the blocking member functions properly.

It will also be apparent that the present invention has a substantial advantage over many other safeties in that the safety button, or finger piece, can be moved to its "on" position when the action is open as well as when it is closed. In fact, the position of the safety, whether "on" or "off", does not interfere in any way with the movement of the breech-bolt. Thus, as will be seen by reference to FIGS. 3 and 4, in which the safety is in the "on" position, if the bolt 12 is manually retracted, projection 60 on blocking member 52 simply rides down the back side of cam 80 under the inwardly bent cam-finger 84 and then along the inner side of the main section of safety bar 64. Similarly, on the return stroke of the breech-bolt with the safety on, whether during manual cycling of the action or on release of the breech-bolt from a bolt-open condition, the firing-pin blocking member 52 is pivoted upward by cam 80 just as the bolt 12 reaches its battery position. Of course, if the safety bar 64 is in its "off" or forward position, as shown in broken lines in the drawings, the projection 60 simply moves straight out from under cam-finger 84 on retraction of the bolt 12 and back to the broken-line position shown in FIG. 4 on return of the bolt to battery.

As will be seen in FIG. 1, the rear portion of safety bar 64 is also provided with a more-or-less conventional trigger-blocking safety device. Thus, a depending leg 86 extends downward from the rear end of bar 64 to a position on the same level with an abutment at the upper end of an upwardly bent finger 88 which extends rearwardly from and is integral with trigger 32. A foot 90 on the bottom of leg 86 extends perpendicular thereto and inward so that it overlies the upturned end of finger 88, when safety bar 64 is in its "safety-on" position, thereby blocking retraction of trigger 32 so that it can not release the hammer. Accordingly, when the firing-pin is blocked by blocking member 52, the trigger is likewise blocked by the leg 86, providing a dual-safety system. Release of the firing-pin by shifting the safety bar 64 forward to its broken-line position simultaneously shifts the leg 86 on bar 64 forward of the abutment on trigger finger 88, as shown in broken lines in FIG. 1, thereby releasing the trigger. The firing mechanism is then in condition to discharge a cartridge when the trigger is pulled.

What is claimed is:

1. In a firearm having a receiver, a breech-bolt for reciprocation within said receiver, a firing pin carried by said breech-bolt for movement into and out of a firing position, a safety device for blocking movement of said firing pin into its firing position comprising, a firing-pin blocking member mounted on the breech-bolt for movement into and out of a blocking position with respect to said firing pin, a safety bar carried by said receiver for movement to and from a safe position and a finger-piece disposed externally of said receiver for moving said safety bar into and out of its safe position, said safety bar having an actuating portion disposed for engagement with said blocking member when said breech-bolt is in battery, such that when said safety bar is in its safe position said blocking member is positively held thereby in blocking relationship with said firing pin, said actuating portion of said safety bar being adapted and arranged to cooperate with said breech-bolt and with said firing-pin blocking member to allow reciprocation of said breech-bolt.

2. A firing-pin safety device as defined in claim 1, wherein said firing-pin blocking member is pivotally mounted on said breech-bolt and has a projection extending laterally of said breech-bolt for engagement by said actuating portion of said safety bar.

3. A firing-pin safety device as defined in claim 2, wherein said safety bar is mounted in a groove in a side wall of said receiver extending longitudinally thereof, said safety bar being an elongated member, a major portion of which is disposed within said groove and having limited longitudinal movement into and out of its safe position, said actuating portion being off-set inwardly with respect to said side wall into alignment with said projection, said finger-piece being mounted adjacent the rear of said receiver and connected to said safety bar near one end thereof, said actuating portion of said safety bar being located adjacent the opposite end of said safety bar, said projection on said blocking member being disposed on said breech-bolt such that it is substantially adjacent said actuating portion on said safety bar when said breech-bolt is in battery, and said actuating portion having a cam for positively holding said blocking member in its blocking position when said safety bar is shifted to one of its limits of movement.

4. A firing-pin safety device as defined in claim 3, wherein said actuating portion of said safety bar is provided with a second cam spaced longitudinally from said first cam for positively moving said blocking member out of blocking relationship with said firing pin upon movement of said safety bar out of its safe position.

5. A firing-pin safety device as defined in claims 3 or 4, which further includes a spring for continuously urging said blocking member out of blocking relationship with said firing pin.

6. A firing-pin safety device as defined in any of claims 1 through 4, wherein said safety bar is also provided with a trigger-blocking member and said trigger has an abutment disposed for engagement by said trigger-blocking member, said trigger-blocking member and abutment being adapted and arranged to block retraction of said trigger when said safety bar is in its safe position and to release said trigger when said safety bar is moved out of said safe position.

* * * * *